United States Patent [19]

Pleska et al.

[11] 4,010,229

[45] Mar. 1, 1977

[54] PROCESS FOR THE MANUFACTURE OF SHORT FIBRILS

[75] Inventors: Jean-Pierre Pleska, Paturages; Michel Marechal, Brussels, both of Belgium

[73] Assignee: Solvay & Cie, Brussels, Belgium

[22] Filed: Jan. 16, 1975

[21] Appl. No.: 541,622

[30] Foreign Application Priority Data

Jan. 18, 1974 Luxembourg ..... 69196

[52] U.S. Cl. ..... 264/13; 162/157 R; 264/140; 264/205

[51] Int. Cl.[2] ..... D01D 5/04

[58] Field of Search ..... 264/13, 141, 140, 205; 425/382.2; 162/157 R

[56] References Cited

UNITED STATES PATENTS

| | | | |
|---|---|---|---|
| 2,728,753 | 12/1955 | Russum et al. | 260/94.9 |
| 3,227,794 | 1/1966 | Anderson et al. | 264/205 |
| 3,386,488 | 6/1968 | Ratzsch et al. | 264/5 |
| 3,461,193 | 8/1969 | Gilardi | 264/205 |
| 3,549,732 | 12/1970 | Rice | 264/143 |
| 3,663,668 | 5/1972 | Fairbanks | 264/176 R |
| 3,706,827 | 12/1972 | Nott et al. | 264/349 |
| 3,756,441 | 9/1973 | Anderson et al. | 264/176 F |
| 3,883,630 | 5/1975 | Raganato | 264/204 |
| 3,885,014 | 5/1975 | Fukada et al. | 264/176 F |
| 3,902,957 | 9/1975 | Koslowski | 162/157 R |

*Primary Examiner*—Jay H. Woo
*Attorney, Agent, or Firm*—Spencer & Kaye

[57] ABSTRACT

A process is provided for the manufacture of fibrils of short length by suddenly releasing the pressure acting on a two-phase liquid mixture of molten polymer and solvent and which is at a high pressure and a high temperature. The two-phase liquid mixture is ejected through a pressure release orifice so as to vaporize the solvent instantaneously and solidify the polymer, and the flow path of the two-phase liquid mixture is perturbed at the instant when it enters the pressure release orifice.

Spinnerets are provided which have a perturbation chamber containing a supply orifice and a pressure release orifice.

25 Claims, 13 Drawing Figures

PROCESS FOR THE MANUFACTURE OF SHORT FIBRILS

FIELD OF THE INVENTION

The present invention relates to a process for the manufacture of fibrils of short length as well as to devices which are particularly suitable for carrying it out.

BACKGROUND OF THE INVENTION

It is well known to produce continuous fibrillated structures or rovings by suddenly releasing the pressure acting on a two-phase liquid mixture which is based on molten polymer and solvent and which is at a high pressure and a high temperature. These continuous, fibrillated structures are, however, very difficult to process directly, mainly because of their extremely high volume and the rate at which they are produced. For this reason, in order to economically process the continuous, fibrillated structures, they are first subjected to a shredding treatment which reduces their dimensions but which has a detrimental effect on their physical properties and which necessitates tying up a large amount of capital and consuming a great deal of energy.

This is why attempts have been made to develop processes which lead directly to the formation of fibrils of short length when the pressure acting on the above-mentioned mixtures is released suddenly.

Thus, in Belgian Pat. No. 787,032, filed Aug. 1, 1972, which corresponds to U.S. patent application Ser. No. 277,033, assigned to the same assignee as the present application, filed Aug. 1, 1972, entitled "Fabrication of Discontinuous Fibrils", which is hereby incorporated by reference, there is described a process for the direct manufacture of short fibrils in which the two-phase liquid mixture is dispersed in an added fluid at the exact instant when the pressure acting on it is released suddenly. According to Belgian Pat. No. 787,033, filed Aug. 1, 1972, which corresponds to U.S. patent application Ser. No. 277,032, assigned to the same assignee as the present application, filed Aug. 1, 1972, entitled "Process for the Manufacture of Discontinuous Fibrils", which is hereby incorporated by reference, a similar result is achieved when the fibrillated structure formed by suddenly releasing the pressure acting on the two-phase liquid mixture is shredded at the very instant when it is formed, by means of a transverse stream of fluid.

Although these processes very considerably improve the technique for the manufacture of discontinuous fibrils, they nevertheless still possess some disadvantages, the main one of which is that they require the use of very large amounts of added fluid in order to produce adequate shredding.

Consequently, there have been continuing investigations for the purpose of developing a process for the direct manufacture of short fibrils, which no longer requires an added fluid to be supplied.

Thus, in Belgian Pat. No. 811,780, filed Mar. 1, 1974, which corresponds to U.S. patent application Ser. No. 450,475, assigned to the same assignee as the present application, filed Mar. 12, 1974, entitled "Process for the Manufacture of Discontinuous Fibrils", which is hereby incorporated by reference, there is described a process for the manufacture of short fibrils which consists of pulverizing mechanically the ejection cone which forms at the outlet of the orifice by means of which the pressure is suddenly released. This technique, however, involves the use of mechanical devices, such as rotary blades revolving at very high speed and at a very short distance from the pressure release orifice. The result of this is that, although this technique enables good results to be achieved, it is very delicate to carry out, requiring special drive means, and can involve stoppages due to mechanical failure.

SUMMARY OF THE INVENTION

It would consequently appear that, hitherto, despite the considerable progress already achieved, no one has yet succeeded in developing a reliable process, which does not require any added fluid, for the direct production of short fibrils by suddenly releasing the pressure acting on two-phase liquid mixtures of molten polymers and solvents. Accordingly, it is an object of the present invention to provide an improved process for directly producing short fibrils by suddenly releasing the pressure acting on a two-phase liquid mixture of molten polymer and solvent. Another object of the present invention is to provide such a process which does not require any added fluid and which is reliable. A further object of the present invention is to provide a process which no longer possesses the above-mentioned disadvantages of the prior processes and which is characterized by extremely great economy in the means which have to be employed.

A still further object of the present invention is to provide devices for performing the method of the present invention.

Additional objects and advantages of the present invention will be set forth in part in the description which follows and in part will be obvious from the description or can be learned by practice of the invention. The objects and advantages are achieved by means of the methods, instrumentalities and combinations particularly pointed out in the appended claims.

To achieve the foregoing objects and in accordance with its purpose, as embodied and broadly described, the present invention provides a process for the manufacture of fibrils of short length by suddenly releasing the pressure acting on a two-phase liquid mixture of molten polymer and solvent and which is at a high pressure and a high temperature, by ejecting the mixture through a pressure release orifice to vaporize the solvent instantaneously and solidify the polymer, and in which the flow path of the two-phase liquid mixture is perturbed at the instant when it enters the pressure release orifice.

As used herein, the term "fibrils of short length" means elongated fibrillated structures consisting of very fine filaments, of a thickness of the order of a micron, connected to one another to form a three-dimensional network. The general shape of these fibrils, which have a flocculent appearance, is oblong. Their length varies approximately from 0.5 mm to 5 cm and their diameter varies approximately from 0.01 mm to 5 mm. The specific surface area of these products is very high; it is greater than 1 $m^2/g$ and in many cases greater than 10 $m^2/g$. These fibrils are an excellent starting material for the production of non-woven textiles and synthetic papers, by the usual methods.

As used herein, the expression "two-phase liquid mixture of molten polymer and solvent" is defined below.

When a very high pressure is applied to a mixture of polymer and a suitable solvent, which possesses a suitable concentration of polymer and which is at a temperature above the melting point of the polymer, it is found that the mixture is in the form of a single homogeneous liquid phase. If, thereafter, the pressure is gradually reduced, while keeping all the other conditions the same, it is found that, from a certain pressure which varies depending on the particular cases, the homogeneous liquid phase becomes cloudy due to the appearance of a system consisting of two liquid phases comprising a continuous polymerrich liquid phase in which droplets of a polymer-depleted liquid phase are dispersed. This system consisting of two liquid phases is the "two-phase liquid mixture" referred to above. The value of the pressure at which this phenomenon of two liquid phases appears can easily be determined experimentally for various values of temperature and polymer concentration. In order to obtain high quality structures by means of the sudden release of pressure, it is advisable to employ mixtures which are in the two-phase state.

In a further aspect of the present invention, a device is provided for the manufacture of fibrils of short length by suddenly releasing the pressure acting on a two-phase liquid mixture of molten polymer and solvent which comprises a spinneret containing a perturbation chamber having at least one supply orifice for receiving the two-phase liquid mixture and a pressure release orifice opposite the supply orifice.

It is to be understood that both the foregoing general description and the following detailed description are exemplary and explanatory, but are not restrictive of the invention.

BRIEF DESCRIPTION OF THE DRAWINGS

The accompanying drawings illustrate, diagrammatically and in cross section, examples of the presently preferred embodiments of the devices according to the invention for practicing the method of the invention and together with the description serve to explain the principles of the invention.

Of the drawings.

DETAILED DESCRIPTION OF THE INVENTION

Figure 1:
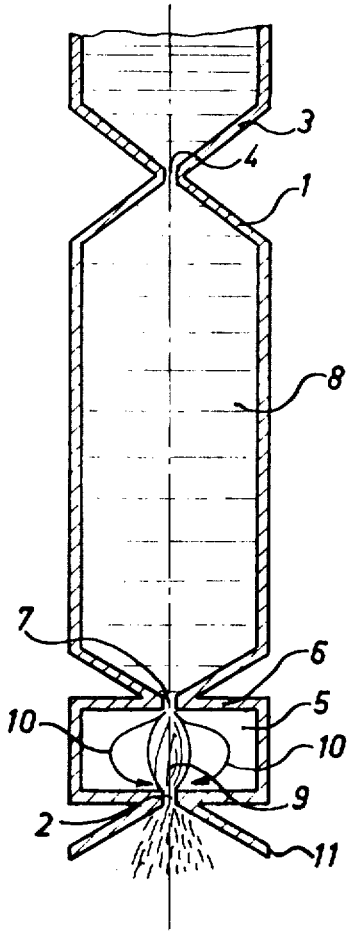
FIG. 1 is a view of a complete device which is suitable for carrying out the process according to the invention.
Figure 2:
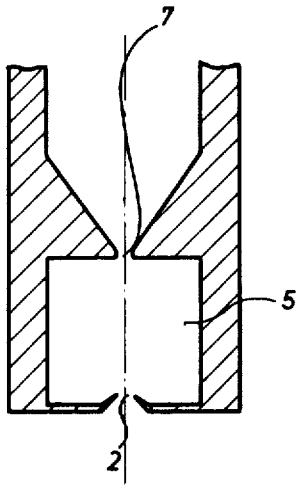
FIGS. 2 to 7 shows alternate embodiments of the terminal part of the device according to FIG. 1.

The polymer or polymers present in the two-phase liquid mixture which is subjected to the sudden release of pressure can be any polymer(s) whatsoever provided that it can lead to the formation of two-phase liquid mixtures in the presence of suitable solvents.

In general, any polymer(s) which can be spun can be used according to the present invention.

By way of example, polyolefins, polyamides, thermoplastic polyesters, polyurethanes, polycarbonates, vinyl polymers (such as polymers based on vinyl chloride, vinyl acetate or vinylidene fluoride) and acrylic polymers (such as polymers of acrylonitrile or methyl acrylate) may be used.

It is preferred, however, to use crystalline polymers, the degree of crystallinity of which, measured by X-ray diffraction, is greater than 10%, and more preferably greater than 20%. In fact, the stretching which the very fine filaments forming the fibrils undergo during the instantaneous vaporization of the solvent, because of the sudden evolution of solvent vapors, imparts an oriented structure to them when they are made of a crystalline polymer, and consequently gives remarkably good mechanical properties.

The best results are obtained starting from crystalline polyolefins. Among the latter, those most used are polymers with a substantially linear structure comprising at least 50 mol% of an alpha-olefin containing 2 to 6 carbon atoms. By way of examples, there may be used high density polyethylene and isotactic polypropylene which are very readily available commercially, as well as isotactic polybut-1-ene and isotactic poly-4-methylpent-1-ene which are produced on a much smaller scale.

With regard to the solvent or solvents employed, it is preferable that they should not dissolve the polymer under normal pressure and temperature conditions (atmospheric pressure and 20° C). Under these conditions, they must not dissolve more than 50 g of polymer per liter, and preferably not more than 10 g of polymer per liter.

In the second place, it is preferable that the boiling point of the solvent or solvents should be below the temperature at which the polymer or polymers can be plastically deformed; they must have a boiling point, at normal pressure, more than 20° C and preferably more than 40° C below the plasticization temperature of the polymer or polymers. Moreover, they must allow two-phase liquid mixtures, as defined above, to form under temperature and pressure conditions which permit instantaneous vaporization of the solvents and solidification of the polymer.

To make matters easier, it is always preferable to use a common solvent when several different polymers are employed.

Among the many solvents which can be used, there may be mentioned especially aliphatic hydrocarbons (such as normal butane, normal pentane, normal hexane, normal heptane and normal octane as well as their isomers), cycloaliphatic hydrocarbons (such as cyclohexane and methylcyclohexane), aromatic hydrocarbons (such as benzene, toluene and xylene), halogenated alkanes (such as chloromethanes, chlorofluoromethanes, chloroethanes and chlorofluoroethanes), alcohols, ketones, esters, amides, nitriles and ethers.

When one or more polymers selected from the group consisting of the crystalline polyolefins are employed, it is preferred to use a solvent selected from the group consisting of aliphatic and cycloaliphatic hydrocarbons containing 4 to 8 carbon atoms such as, for example, hexane and cyclohexane of technical quality.

In the process according to the present invention, it is advisable to choose the pressure of the mixture which is subjected to the sudden release of pressure in such a way that it is in the form of a two-phase liquid mixture. The same applies to the temperature and to the polymer concentration.

It is generally preferred to work at a temperature of between 100° and 300° C and more preferably between 125° and 250° C.

The concentration of polymer is generally between 1 and 500 g per kg of mixture. It is preferred to employ mixtures containing 10 to 300 g of polymer per kg of solvent, and more preferably 50 to 200 g/kg.

In addition to the polymer and the solvent which, as has been stated, can be individual components or can themselves consist of mixtures, the two-phase liquid mixture can also contain customary additives for polymers such as anti-oxidants, light-stabilizing agents, antistatic agents, surface-active agents, strengthening agents, fillers, pigments, dyestuffs and nucleation agents, provided that these additives do not have a detrimental effect on the formation of the two-phase liquid mixture, the instantaneous vaporization of the solvent and the solidification of the polymer.

During the sudden pressure release procedure, the pressure of the two-phase liquid mixture or mixtures is brought to a value close to atmospheric pressure, and preferably to an absolute pressure of less than 3 kg/cm², within a very short period of time, preferably less than 1 second. This release of pressure is achieved by passing the mixture through a preferably cylindrical orifice, the diameter of which is between 0.1 and 3 mm and preferably between 0.5 and 1.5 mm, and the length/diameter ratio of which is between 0.1 and 10 and preferably between 0.5 and 2.

In the case where the orifice does not have a circular cross section, the diameter which must be taken into consideration is the hydraulic diameter of the orifice.

In accordance with the present invention, the flow of two-phase liquid mixture which travels towards the inlet of the pressure release orifice is perturbed just before entering therein. Since the continuous liquid phase of the two-phase liquid mixture is the polymer-rich phase, the two-phase liquid mixture possesses an extremely high viscosity. Because of this, it is assumed that the mixture travels under conditions of laminar flow, with the fluid streams having parallel trajectories. The effect of the perturbation is to alter these conditions of flow just before the two-phase liquid mixture enters the pressure release orifice. Of course, this perturbation must be effected under conditions such that it has not yet become damped at the instant when the two-phase liquid mixture enters the pressure release orifice.

According to a preferred embodiment of the present invention, the flow path of the two-phase liquid mixture is perturbed by deflecting, upstream from the pressure release orifice, a part of the two-phase liquid mixture flow subjected to the sudden release of pressure, and by guiding the deflected part so that it enters the pressure release orifice in a direction which makes an angle with the axis of the pressure release orifice.

The angle formed between the direction of the part of the flow which is deflected to the greatest extent and the axis of the pressure release orifice is preferably between 30° and 135°. The best results are obtained when this angle is between 75° and 120°. In the simplest embodiment, this angle has a value of 90°.

This deflection can be effected advantageously by passing the two-phase liquid mixture subjected to the sudden release of pressure through a perturbation chamber opening onto the pressure release orifice.

According to a variant of this embodiment, the two-phase liquid mixture flow entering the perturbation chamber is divided, by means of a supply orifice, into a plurality of flows.

This division of the two-phase liquid mixture flow can be effected by increasing the number of orifices which supply the perturbation chamber, or by interposing an element or a grid for dividing up the flow, preferably a metal gauze, in the trajectory followed by this flow.

When a metal gauze is used, it can, for example, be positioned above the supply orifice of the perturbation chamber, that is to say against the upstream face of the partition in which this supply orifice is formed or pierced. Preferably, however, the metal gauze is positioned in the perturbation chamber, preferably against the partition possessing the supply orifice. The metal gauze should preferably be positioned so as to be perpendicular to the direction of the two-phase liquid mixture flow.

The mesh opening of the metal gauze must be at least 0.1 mm so as to avoid any danger of choking and possible clogging. The size of the meshes of the metal gauze can be as large as the size of the supply orifice and can even exceed this value provided, of course, that at least one of its constituent strands is opposite the supply orifice, that is to say on the trajectory followed by the two-phase liquid mixture flow.

It is also possible to cause the two-phase liquid mixture flow to divide by supplying the perturbation chamber via a plurality of supply orifices, these orifices being formed or pierced in the upstream partition or walk which defines the perturbation chamber. The axes of these orifices can be parallel to one another or can be inclined relative to one another.

It is, however, very obvious that these two variants can be combined and that it is possible advantageously to supply the perturbation chamber via several orifices and moreover to equip this chamber with a metal gauze.

It can be valuable to provide a diverging component at the outlet of the pressure release orifice in order to channel and guide the short fibrils issuing from this orifice. It has been found that it is advisable, however, for the angle of this diverging component to be at least 150°.

Finally, it has been found that it is preferable for the two-phase liquid mixture to enter the perturbation chamber via one or more orifices, the angle formed by the inlet walls of which is at most equal to 30° or at least equal to 150°.

The processes described above make it possible to produce fibrils of short length directly and economically, but this is, however, frequently accompanied by the undesirable formation of a relatively large number of pellets, that is to say small dense particles having the structure of a film or a skin, the largest dimension of which can be as much as and can exceed 0.5 mm.

The presence of these pellets in the short fibrils thus produced proves objectionable when these fibrils are being processed subsequently in order to manufacture synthetic papers. It is found, in fact, that these pellets are difficult to remove and that they are generally to be found, in the papers produced, in the form of transparent specks or impurities which have a detrimental effect on the pulp of the finished products.

In a preferred embodiment of the invention, it is possible substantially to reduce the formation of pellets and even to eliminate it completely by lubricating the wall of the pressure release orifice by means of a film of a lubricant which is incompatible with the two-phase liquid mixture.

According to one embodiment of this aspect of the invention, it is possible to coat the walls of the pressure release orifice with a thin skin of a suitable lubricant such as, for example, a silicone.

However, the substantial improvement observed in this case from the point of view of reducing the number of pellets is not permanent. It is noted, in fact, that the number of pellets formed, which is markedly reduced when the device is brought into use, tends to increase gradually as a function of the period of time for which the device is used.

Consequently, according to a preferential embodiment, the walls of the pressure release orifice are lubricated by means of the continuous flow, formed at the inlet of the pressure release orifice, of a film of a liquid lubricant which is incompatible with the two-phase liquid mixture.

By following this procedure, it has, in fact, been found that the decrease in the number of pellets formed, or their elimination, is maintained with the passage of time.

The liquid lubricant employed in the process according to this variant of the present invention can be any liquid lubricant whatsoever, provided that it is incompatible with the two-phase liquid mixture, that is to say, provided that it forms a continuous phase which is distinct from this mixture, and in particular, provided that it does not dissolve the polymer present in this mixture. This lubricant is preferably raised to a temperature close to the temperature of the two-phase liquid mixture before being conveyed onto the wall of the pressure release orifice.

For reasons of simplicity and economy, however, the lubricant used preferably is water which optionally contains a wetting agent. This type of lubricant, in fact, enables excellent results to be achieved. Moreover, the short fibrils thus produced are very easily suspended in water even when the polymer of which they are made is hydrophobic. Finally, when the fibrils are being produced, the water vaporizes and forms a sheath which surrounds the flow of fibrils and prevents the latter from becoming struck on the hot parts of the pressure release spinneret.

The liquid lubricant is introduced at a flow rate of between 30 and 250 liters/hour, and preferably between 40 and 150 liters/hour, when the special devices described below are used, the pressure release orifice of which has a diameter of the order of 1 mm.

In order to make it possible to carry out the process according to the invention, several devices of a particular type have been produced and these devices also form part of the present invention.

These devices or spinnerets differ mainly from those already known in that they comprise a perturbation chamber possessing at least one supply orifice and a pressure release orifice opposite the latter.

In the simplest embodiment of these devices, the supply orifice, which is also cylindrical, and the pressure release orifice are coaxial and the perturbation chamber possesses a symmetry of revolution about their common axis.

According to a first variant, the perturbation chamber can be equipped with a metal gauze or can be supplied via a plurality of supply orifices.

According to a second variant, the perturbation chamber can be surrounded by a second chamber which is peripheral and which is connected to a source of liquid lubricant which opens into the perturbation chamber via an annular slit which surrounds the inlet of the pressure release orifice. In this way, the peripheral chamber communicates with the perturbation chamber so as continuously to direct a film of liquid lubricant onto the wall of the pressure release orifice.

Turning now to the drawings, as is apparent in FIGS. 1 to 7, a spinneret 1 made in accordance with the invention, possesses a pressure release orifice 2 and a pre-(pressure release) device. This pre-(pressure release) device, which consists, according to the embodiment represented, of a partition 3 possessing a central orifice 4, is by no means indispensable. Its role is to cause a pressure drop in the mixture of molten polymer and solvent which is in the form of a single-phase liquid passing through the spinneret, in order to bring about the formation of a two-phase liquid mixture.

This method of working possesses certain advantages: firstly, it is simpler to prepare a single-phase mixture, and secondly, the two-phase liquid mixture is of more uniform quality.

However, this device can be dispensed with in the case where the spinneret is supplied directly with a two-phase liquid mixture of polymer and solvent.

The spinneret also comprises a perturbation chamber 5 defined especially by the wall 20 possessing the pressure release orifice 2 and by a flat upper wall 6 possessing the supply orifice 7 at its center. The supply and pressure release orifices are opposite and coaxial. The perturbation chamber is cylindrical with a circular cross section. The orifices are positioned at the centers of the bases. The distance between the supply and pressure release orifices (height) is generally less than 10 cm and preferably less than 7.5 cm. Additional information on the subject of this chamber will be provided later.

As FIGS. 2 to 7 show, the inlet and the outlet of the pressure release orifice 2 can be given various profiles.

When the chamber 8 of the spinneret is supplied with a two-phase liquid mixture of molten polymer and solvent, this mixture, because of the alignment of the orifice 7 in the wall 6 and of the pressure release orifice 2, flows through the perturbation chamber 5 along a preferential central fluid stream 9 and along side streams 10, which, in the vicinity of the pressure release orifice 2, are guided transversely relative to the central stream by the walls of the perturbation chamber. The angle of incidence of these side streams can be varied by altering the profile of the wall 20 possessing the pressure release orifice 2, as is apparent in FIGS. 2 to 7 where this wall is identified by 20*a* to 20*f*, respectively. It is seen that the angle formed between the axis of the pressure release orifice and the wall of the chamber in which this orifice is pierced or formed determines the angle of incidence of the most eccentric side streams which are those deflected to the greatest extent. This angle is preferably between 30° and 135°, the best results being obtained when it is between 75° and 120°. In the simplest embodiments, as seen in FIGS. 1, 3, 4, 7 and 8, it is equal to 90°. Furthermore, it can also be advantageous to give the perturbation chamber 5 a profile, for example by removing sharp angles, as is shown especially in FIG. 7, so that the trajectory of the side streams which are deflected to the greatest extent and which travel in the vicinity of the wall is tangential at every point to the wall. In this case, the speed of the part of the flow which is deflected to the greatest extent is at a maximum.

Figure 8:
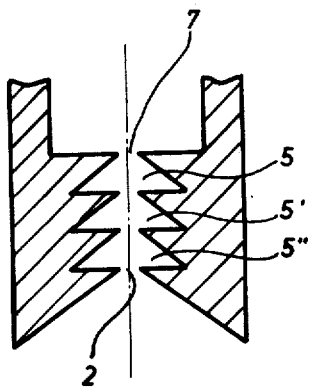
FIG. 8 shows an alternate embodiment of a device which makes use of several perturbation chambers arranged in series.

It can also be advantageous to produce a spinneret like that represented in FIG. 8, in which several perturbation chambers arranged in series are provided.

It is moreover desirable that the perturbation chamber should fulfill various criteria in order to optimize its effectiveness.

Thus it is obviously advisable for the perturbation chamber to have a transverse dimension sufficient to form side streams which can perturb the central stream at the inlet of the pressure release orifice 2.

For a similar reason, it is also advisable for the distance between the orifices of the perturbation chamber (height of the chamber) also to be greater than the diameter of the supply orifice. It is in fact obvious that when the height of the perturbation chamber is too small, the deflected side streams cannot be effectively guided transversely relative to the central stream.

On the other hand, when the height of the perturbation chamber becomes too great, the deflected transverse streams have a tendency to rejoin the central stream and to become parallel to it again before reaching the pressure release orifice. It has been found that the height which the perturbation chamber can have is related to the diameter of this chamber. In fact, in order to achieve maximum effectiveness, it is necessary for the ratio of the height of this chamber (distance between orifices) to its lateral dimension to be less than 5 and preferably less than 3.

Finally, it has been found that it is preferable for the diameter of the supply orifice to be at least equal to half the diameter of the pressure release orifice.

Figure 9:
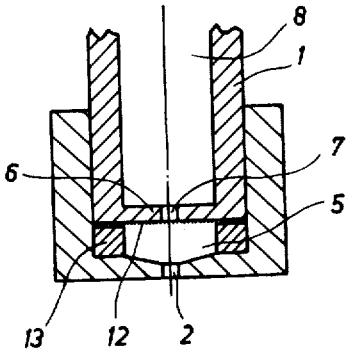
FIG. 9 is a view of a device which makes use of a metal gauze.

As is apparent in FIG. 9, the spinneret 1 for effecting sudden pressure release can be equipped with a metal gauze 12 positioned in the perturbation chamber 5. This perturbation chamber 5 is defined especially by the wall 20g possessing the pressure release orifice 2 and by a flat upper wall 6 possessing a supply orifice 7 at its center. The pressure release orifice 2 and the supply orifice 7 are, in this particular case, opposite and coaxial. The side wall 22 of the perturbation chamber 5 which is cylindrical is defined by an annular ring 13. It should, however, be noted that the perturbation chamber 5 can have some other shape and especially that of a parallelepiped. The annular ring 13 fulfills a two-fold function: firstly, this ring defines the height of the perturbation chamber 5, and secondly, it holds the fine mesh gauze 12 located in the perturbation chamber in place against the wall 6 possessing the supply orifice 7.

Figure 10:
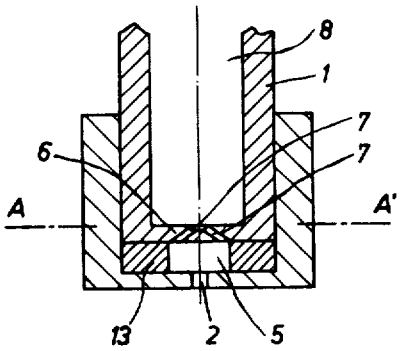
FIG. 10 is a view of a device possessing two supply orifices.
Figure 11:
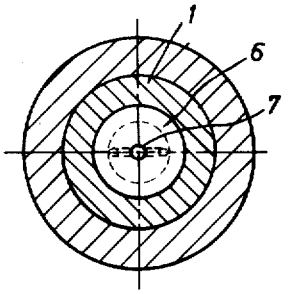
FIG. 11 is a cross-sectional view along the axis A—A' of FIG. 10.
Figure 12:
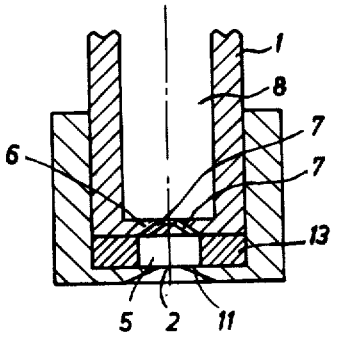
FIG. 12 is a view of an alternate embodiment of the device according to FIG. 10.

The spinnerets represented in FIGS. 10, 11 and 12 are of the same type as that represented in FIG. 9, except that they do not possess any metal gauze located in the perturbation chamber. Moreover, communication between the supply chamber 8 and the perturbation chamber 5 is provided by two supply orifices 7, the axes of which are inclined relative to one another and which join up again to form a single orifice on the side of the supply chamber. In these spinnerets, the annular ring 13 delimiting the cylindrical side wall of the perturbation chamber 5 serves solely to determine the height of this chamber.

As has been stated, the spinnerets represented in FIGS. 10, 11 and 12 could also be provided with a metal gauze positioned in their perturbation chamber and/or could be equipped with two or more orifices, the axes of which would be parallel.

As is apparent especially in FIGS. 1, 2, 3, 4, 8 and 12, it is possible to provide a diverging component 11 at the outlet of the pressure release orifice, the angle of this diverging component being preferably greater than 150°.

Figure 13:
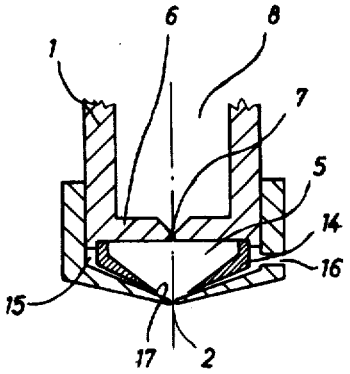
FIG. 13 is a view of an alternate embodiment of a spinneret according to the invention, which makes it possible to form a continuous film of lubricant on the wall of the pressure release orifice.

Finally, as is apparent in FIG. 13, the spinneret 1 which possesses a pre-(pressure release) chamber 8, an orifice 7 for supplying the perturbation chamber 5 and a pressure release orifice 2 can also be equipped with a peripheral chamber 15 which surrounds the perturbation chamber 5, the partition 14 separating these chambers being interrupted at the inlet of the pressure release orifice 2 so as to form an annular slit 17 coaxial with the pressure release orifice. The peripheral chamber 15 is also equipped with a connection 16 to enable it to be brought into communication with a source of liquid lubricant.

The process according to the invention is moreover illustrated by the practical embodiment examples which now follow. It is, however, to be understood that these examples are given purely by way of illustration and that they do not in any way limit the scope of the present invention.

It is possible, in particular, to produce other types of spinnerets and especially spinnerets which make it possible to employ two-phase liquid mixtures of different compositions.

EXAMPLE 1

A two-phase liquid mixture is produced by bringing a mixture comprising 15% by weight of ELTEX A 1050 and 85% by weight of technical hexane to a temperature of 195° C and to a pressure of 63 kg/cm². These conditions correspond to the start of the appearance of two liquid phases. ELTEX A 1050 is a high density polyethylene with a melt index of 5, produced and sold by Solvay & Cie. of Brussels, Belgium.

Figure 4:
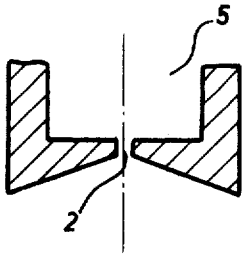
Figure 5:
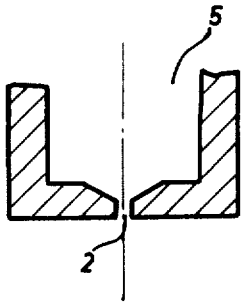

The pressure acting on this mixture is released by passing the latter through a spinneret possessing a perturbation chamber as represented in FIG. 4 of the attached drawings and having the following geometric characteristics:

a. ratio of the diameter of the perturbation chamber to the diameter of the supply orifice 7 (not shown) equal to 16;

b. ratio of the height of the perturbation chamber to the diameter of the supply orifice 7 equal to 5;

c. ratio of the height of the perturbation chamber to the diameter of this chamber equal to 0.313; and d. diameters and heights of the supply orifice and of the pressure release orifice: 1 mm.

The diverging component 11 extending from the orifice for effecting sudden pressure release opens out at an angle of 150°.

The two-phase liquid mixture is discharged at the rate of 21.4 kg of polymer per hour.

Short fibrils of average length 1.7 mm are obtained directly. The specific surface area of these fibrils is as much as 35 m²/g.

EXAMPLE 2

The procedure of Example 1 is followed, except that the mixture is subjected beforehand to a pre-(pressure release) of 12 kg/cm². Short fibrils of average length 1.9 mm are also obtained.

The specific surface area of the product is as much as 23 m²/g.

EXAMPLE 3

The procedure of Example 2 is followed, except for the fact that the spinneret possesses the following altered geometric characteristics:

ratio of the height of the perturbation chamber to the diameter of the supply orifice 7 equal to 200; and ratio of the height of the perturbation chamber to the diameter of this chamber equal to 12.5.

A continuous fibrillated roving is obtained.

This negative result is probably due to the fact that the perturbation chamber possesses too great a height relative to its diameter.

EXAMPLE 4

Figure 3:
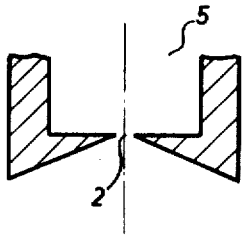

The procedure of Example 2 is followed, but using a spinneret possessing a perturbation chamber as represented in FIG. 3, the geometric characteristics of which are identical to those of Example 1.

Short fibrils of average length 1.8 mm are obtained. Their specific surface area is as much as 21 m²/g

EXAMPLE 5

The procedure of Example 4 is followed, apart from the fact that the spinneret possesses the following altered geometric characteristics:

ratio of the height of the perturbation chamber to the diameter of the supply orifice 7 equal to 40; and ratio of the height of the perturbation chamber to the diameter of this chamber equal to 2.5.

Short fibrils of average length 2.3 mm are again obtained, the specific surface area of which is as much as 26 m²/g.

EXAMPLE 6

Figure 6:
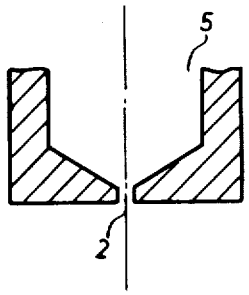
Figure 7:
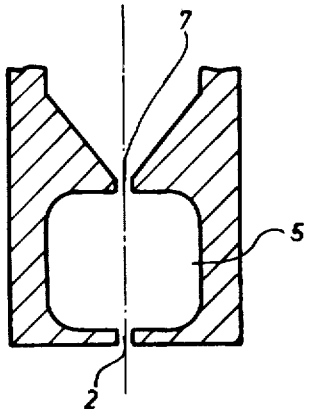

The procedure of Example 2 is followed, but using a spinneret like that represented in FIG. 6, the geometric characteristics of which are as follows:

a. ratio of the diameter of the perturbation chamber to the diameter of the supply orifice 7 (not shown) equal to 6;

b. ratio of the height of the perturbation chamber to the diameter of the supply orifice 7 equal to 3;

c. ratio of the height of the perturbation chamber to the diameter of this chamber equal to 0.5; and d. diameters and heights of the supply orifice and of the pressure release orifice: 1 mm Short fibrils with a specific surface area of 30 m²/g and the average length of which is 2.1 mm are obtained.

EXAMPLE 7

The procedure of Example 2 is followed, but the pressure release spinneret is equipped with a diverging component 11 which opens out at an angle of 150°.

Moreover, the geometric characteristics of the spinneret are altered as follows:

a. ratio of the diameter of the perturbation chamber to the diameter of the supply orifice 7 equal to 13.3;

b. ratio of the height of the perturbation chamber to the diameter of the supply orifice 7 equal to 4.16;

c. ratio of the height of the perturbation chamber to the diameter of this chamber equal to 0.313;

d. diameters of the supply orifice 7 and of the pressure release orifice: 1.2 mm; and e. heights of the supply orifice 7 and of the pressure release orifice: 1 mm.

It is found that the weight of polymer which is discharged changes to 30 kg/hour. Moreover, short fibrils of average length 2.2 mm are obtained.

The specific surface area is 30 m²/g.

EXAMPLE 8

The procedure of Example 7 is followed, but the geometric characteristics of the spinneret are altered as follows:

a. ratio of the diameter of the perturbation chamber to the diameter of the supply orifice 7 equal to 10.7;

b. ratio of the height of the perturbation chamber to the diameter of the supply orifice 7 equal to 3.34;

c. diameters of the supply orifice 7 and of the pressure release orifice: 1.5 mm; and d. heights of the supply orifice 7 and of the pressure release orifice: 1 mm.

It is found that the weight of polymer which is discharged changes to 49 kg/hour and short fibrils of average length 2.6 mm are obtained.

The specific surface area is 23 m²/g.

EXAMPLE 9

The procedure of Example 8 is followed, but using a spinneret of the type which is illustrated diagrammatically in FIG. 8 of the attached drawings and which thus possesses three perturbation chambers arranged in series.

The diameters of the successive orifices in the direction of flow of the two-phase liquid mixture are respectively 2 mm, 1.5 mm, 1.2 mm and 1 mm. The diverging component 11 opens out at an angle of 150°.

Short fibrils of average length 1.9 mm, the specific surface area of which is 10 m²/g, are obtained.

EXAMPLE 10

A mixture comprising 10% by weight of PROFAX 6501 and 90% by weight of technical pentane is raised to a temperature of 195° C and to a pressure of 83 kg/cm². PROFAX 6501 is a polypropylene with a melt index of 2.9, produced and sold by HERCULES INC.

The pressure acting on this mixture is released by passing the latter through a spinneret possessing a perturbation chamber equipped with a metal grid as represented in FIG. 9 of the drawings and possessing the following geometric characteristics:

a. ratio of the diameter of the perturbation chamber 5 to the diameter of the supply orifice 7 equal to 6;

b. ratio of the height of the perturbation chamber to the diameter of the supply orifice 7 equal to 2;

c. ratio of the height of the perturbation chamber to the diameter of this chamber equal to 0.333;

d. diameter and height of the supply orifice 7 both equal to 1 mm; and e. diameter and height of the pressure release orifice 2, respectively, 1.1 mm and 1 mm.

Moreover, the metal gauze 12 possesses square meshes of diameter 0.4 mm.

At the instant when the mixture of polymer and solvent enters the supply chamber 8, it undergoes a pre-(pressure release) of 3 kg/cm² in order to make it a two-phase liquid mixture.

The two-phase liquid mixture is discharged through the pressure release orifice 2 at the rate of 10.3 kg of polymer per hour.

Short fibrils of average length 1.7 mm are obtained directly. The specific surface area of these short fibrils is 3 $m^2/g$.

EXAMPLE 11

The pressure acting on the mixture prepared according to Example 10 is released by passing the mixture through a spinneret possessing a perturbation chamber as represented in FIGS. 10 and 11 of the drawings and possessing the following characteristics:

The perturbation chamber 5 has a height of 2 mm and a diameter of 4 mm.

The pressure release orifice 2 has a height and a diameter of 1 mm.

Communication between the supply chamber 8 and the perturbation chamber 5 is provided by two orifices of diameter 0.8 mm and of length 1.43 mm, the axes of the two orifices each making an angle of 45° with the longitudinal axis of the spinneret.

At the instant when the mixture of molten polymer and solvent enters the supply chamber 8, it undergoes a pre-(pressure release) of 3 $kg/cm^2$ in order to make it a two-phase liquid mixture.

The two-phase liquid mixture is discharged through the pressure release orifice 2 at the rate of 13.9 kg of polymer per hour.

Short fibrils of average length 1.9 mm are obtained directly. The specific surface area of these short fibrils is 3 $m^2/g$.

EXAMPLE 12

The pressure acting on the mixture prepared according to Example 10 is released by passing the mixture through a spinneret possessing a perturbation chamber as represented in FIG. 12 of the drawings.

This spinneret possesses identical characteristics to those of the spinneret which is represented in FIGS. 10 and 11 and which was used in Example 11, except for the fact that the pressure release orifice 2 is defined by an edge (zero height) and is equipped with a deflector 11, the angle of divergence of which is 150°.

At the instant when the mixture of molten polymer and solvent enters the supply chamber 8, it undergoes a pre-(pressure release) of 3 $kg/cm^2$ in order to make it a two-phase liquid mixture.

The two-phase liquid mixture is discharged through the pressure release orifice 2 at the rate of 14.3 kg of polymer per hour.

Short fibrils of average length 1.2 mm are obtained directly. The specific surface area of these short fibrils is 3 $m^2/g$.

EXAMPLE 13

A mixture comprising 85% by weight of technical hexane and 15% by weight of ELTEX A 1050 containing 0.5% by weight of calcium stearate is produced and this mixture is raised to a temperature of 194° C and to a pressure of 66 $kg/cm^2$.

The pressure acting on this mixture is released by passing the latter through a spinneret possessing a perturbation chamber like that represented in FIG. 13 and possessing the following characteristics:

a. ratio of the diameter of the perturbation chamber 5 to the diameter of the supply orifice 7 equal to 16;

b. ratio of the height of the perturbation chamber 5 to the diameter of the supply orifice 7 equal to 3;

c. ratio of the height of the perturbation chamber 5 to the diameter of this chamber equal to 0.187; and d. diameters and heights of the supply orifice and of the pressure release orifice: 1 mm.

At the instant when the mixture of polymer and solvent enters the supply chamber 8, it undergoes a pre-(pressure release) of 3 $kg/cm^2$ in order to make it a two-phase liquid mixture.

During the pressure release procedure, water at 195° C and under a pressure of 44 $kg/cm^2$ is injected through the connection 16 at a rate of 95 liters/hour.

The two-phase liquid mixture is discharged at the rate of 14.4 kg of polymer per hour.

Short fibrils of average length 2.3 mm are obtained directly. These fibrils are free from pellets.

When the injection of water is interrupted, the rate at which the mixture passes through changes to 16.4 kg of polymer per hour. The fibrils produced then have an average length of 1.9 mm and their production is accompanied by the formation of pellets. The synthetic paper produced from the latter fibrils possesses a defective pulp because an average of 9 large pellets per $dm^2$ is found to be present.

Likewise, the fibrils produced by means of a device comprising a perturbation chamber equipped with four supply orifices which are curved and profiled so as to introduce the two-phase liquid mixture into the perturbation chamber in a direction which makes an angle of approximately 45° with the axis of the pressure release orifice (LECHLER KS 11 pulverizer) also contain a larger number of pellets.

It will be understood that the above description of the present invention is susceptible to various modifications, changes and adaptations and the same are intended to be comprehended within the meaning and range of equivalents of the appended claims.

We claim:

1. In a process for the manufacture of fibrils of short length by abruptly releasing the pressure acting on a two-phase liquid mixture of molten polymer and solvent and which is at a high pressure and a high temperature, and by ejecting the mixture through a pressure release orifice to vaporize the solvent instantaneously and solidify the polymer, the improvement wherein the flow path of the two-phase liquid mixture is disturbed at the instant when it enters the pressure release orifice.

2. Process according to claim 1 wherein the flow path of the two-phase liquid mixture is disturbed by deflecting a part of the flow and guiding the deflected flow to enter the pressure release orifice in a direction which makes an angle with the axis of the pressure release orifice.

3. Process according to claim 2 wherein the angle formed between the direction of the part of the flow which is deflected to the greatest extent and the axis of the pressure release orifice is between 30° and 135°.

4. Process according to claim 2 wherein the part of the flow which is deflected to the greatest extent is guided along a trajectory suitable for imparting the maximum speed to it.

5. Process according to claim 1 wherein the flow path of the two-phase liquid mixture is perturbed by deflecting a part of the flow by passing through a perturbation chamber opening onto the pressure release orifice and the deflected flow is guided to enter the pressure release orifice in a direction which makes an angle with the axis of the pressure release orifice.

6. Process according to claim 5 wherein the perturbation chamber possesses a supply orifice opposite the pressure release orifice.

7. Process according to claim 6 wherein the distance between the supply orifice and the pressure release orifice is less than five times the transverse dimension of the perturbation chamber, said transverse dimension being transverse to the general direction of flow.

8. Process according to claim 5 wherein part of the flow is deflected and the perturbation chamber has a profile such that the trajectory of the deflected flow in the vicinity of the walls of the chamber is tangential to the walls at every point of the walls.

9. Process according to claim 5 wherein several perturbation chambers are arranged in series and communicate via orifices.

10. Process according to claim 5 wherein the axis of the pressure release orifice and the wall of the perturbation chamber in which the pressure release orifice is formed make an angle of between 30° and 135°.

11. Process according to claim 6 wherein the distance between the supply orifice and the pressure release orifice is greater than the diameter of the supply orifice.

12. Process according to claim 6 wherein the diameter of the supply orifice is at least equal to half the diameter of the pressure release orifice.

13. Process according to claim 6 wherein the supply orifice and the pressure release are coaxial.

14. Process according to claim 13 wherein the perturbation chamber possesses a symmetry of revolution about the axis of the supply and pressure release orifices.

15. Process according to claim 5 wherein the two-phase liquid mixture flow entering the perturbation chamber is divided into a plurality of flows.

16. Process according to claim 15 wherein the two-phase liquid mixture flow is divided by passing the flow through a grid provided in the perturbation chamber.

17. Process according to claim 15 wherein the two-phase liquid mixture flow is divided by supplying the perturbation chamber via a plurality of supply orifices.

18. Process according to claim 5 wherein the two-phase liquid mixture enters the perturbation chamber via at least one supply orifice, the angle formed by the inlet walls of which is less than 30° or at least equal to 150°.

19. Process according to claim 5 wherein the end of the pressure release orifice is extended by a diverging component, the angle of which is at least equal to 150°.

20. Process according to claim 1 wherein the wall of the pressure release orifice is lubricated by means of a film of a lubricant which is incompatible with the two-phase liquid mixture.

21. Process according to claim 20 wherein the wall of the pressure release orifice is lubricated by the continuous formation, at the inlet of this orifice, of a film of a liquid lubricant which is incompatible with the two-phase liquid mixture.

22. Process according to claim 21 wherein the liquid lubricant is water.

23. Process according to claim 21 wherein the liquid lubricant is water containing a wetting agent.

24. Process according to claim 21 wherein the liquid lubricant is introduced at a flow rate of between 30 liter/hour and 250 liter/hour.

25. Process according to claim 2 wherein the angle formed between the direction of the part of the flow which is deflected to the greatest extent and the axis of the pressure release orifice is between 75° and 120°.

* * * * *